US006278235B1

(12) United States Patent
Nakatani et al.

(10) Patent No.: US 6,278,235 B1
(45) Date of Patent: Aug. 21, 2001

(54) FLAT-TYPE DISPLAY APPARATUS WITH FRONT CASE TO WHICH GRID FRAME WITH EXTENDED ELECTRODES FIXED THERETO IS ATTACHED

(75) Inventors: Toshifumi Nakatani; Takashi Kanehisa; Kenji Fujishiro, all of Osaka; Makoto Inada, Nara, all of (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/367,186

(22) PCT Filed: Dec. 17, 1990

(86) PCT No.: PCT/JP98/05732

§ 371 Date: Aug. 9, 1999

§ 102(e) Date: Aug. 9, 1999

(87) PCT Pub. No.: WO99/33083

PCT Pub. Date: Jul. 1, 1999

(30) Foreign Application Priority Data

Dec. 22, 1997 (JP) ..... 9-353742

(51) Int. Cl.[7] ..... H01J 1/62; H01J 63/04

(52) U.S. Cl. ..... 313/497; 313/495; 313/496; 313/422

(58) Field of Search ..... 313/497, 496, 313/495, 422, 482

(56) References Cited

U.S. PATENT DOCUMENTS

| | | | |
|---|---|---|---|
| 4,145,633 | 3/1979 | Peters | 313/422 |
| 4,891,552 | 1/1990 | Moriyama et al. | 313/495 |
| 4,900,981 | 2/1990 | Yamazaki | 313/422 |
| 4,908,539 | 3/1990 | Meyer | 315/169.3 |
| 4,982,134 | 1/1991 | Anono et al. | 313/422 |
| 5,256,937 | 10/1993 | Bubeck et al. | 313/495 |
| 5,504,387 | 4/1996 | Hamagishi | 313/496 |
| 5,652,083 | 7/1997 | Kumar et al. | 430/315 |

FOREIGN PATENT DOCUMENTS

| | | |
|---|---|---|
| 0 172 089 | 2/1986 | (EP) . |
| 0 312 007 | 4/1989 | (EP) . |
| 0 404 022 | 12/1990 | (EP) . |
| 0 572 777 | 12/1993 | (EP) . |
| 0 614 209 | 9/1994 | (EP) . |
| 0 628 982 | 12/1994 | (EP) . |
| 0 739 029 | 10/1996 | (EP) . |
| 53-38260 | 4/1978 | (JP) . |
| 53-74357 | 7/1978 | (JP) . |
| 61-214337 * | 9/1986 | (JP) . |
| 62-29046 | 2/1987 | (JP) . |
| 62-229736 | 10/1987 | (JP) . |
| 2-61946 | 3/1990 | (JP) . |
| 2-288052 | 11/1990 | (JP) . |
| 3-67444 | 3/1991 | (JP) . |
| 3-149728 | 6/1991 | (JP) . |
| 4-249048 | 9/1992 | (JP) . |
| 96/30926 | 10/1996 | (WO) . |
| 97/15912 | 5/1997 | (WO) . |

* cited by examiner

*Primary Examiner*—Vip Patel
*Assistant Examiner*—Kevin Quarteman
(74) *Attorney, Agent, or Firm*—Merchant & Gould P.C.

(57) ABSTRACT

A back electrode (6), linear hot cathodes (7) as electron beam sources, and an electrode unit (8) are placed on and fixed to a rear case (4). On the other hand, wire electrodes (9) fixed to a grid frame (10) are positioned relative to stripes of a phosphor screen (2) and are then placed on and fixed to a supporting frame (11) placed in a front case (3) using stud pins (21). According to such a configuration, when the front case and the rear case are bonded and are thus fixed, the position shift between the phosphor screen (2) and the wire electrodes (9) can be suppressed within a tolerance. As a result, a flat-type display apparatus that can display excellent images can be provided.

2 Claims, 2 Drawing Sheets

FLAT-TYPE DISPLAY APPARATUS WITH FRONT CASE TO WHICH GRID FRAME WITH EXTENDED ELECTRODES FIXED THERETO IS ATTACHED

TECHNICAL FIELD

The present invention relates to a flat-type display apparatus used for a television receiver, a computer-terminal display unit, or the like.

BACKGROUND ART

A flat-type display apparatus in which images, characters, and the like are displayed with high precision in the following manner has been developed. The flat-type display apparatus comprises electron beam sources and a flat electrode unit in which a plurality of electron-beam control electrodes are layered. After being focused, modulated, and deflected by the electrode unit, electron beams are further focused by wire electrodes formed by extending a plurality of wires and then are irradiated onto a phosphor screen to cause light emission.

A conventional flat-type display apparatus will be explained with reference to FIG. 2 as follows.

A conventional flat-type display apparatus 101 comprises a back electrode 106, a plurality of linear hot cathodes 107 as electron beam sources, a flat electrode unit 108, and a grid frame 110 to which wire electrodes 109 as extended electrodes have been fixed while being extended thereon orthogonally to the linear hot electrodes 107, which are housed in a vacuum case 105. The vacuum case 105 is formed of a front case 103 having a phosphor screen 102 formed on its inner face and a rear case 104.

In this case, the electrode unit 108 comprises an extracting electrode 111, a modulating electrode 112, a horizontal deflection electrode 113, and a vertical deflection electrode 114. The respective electrodes are electrically insulated from and are fixed to one another while maintaining predetermined spaces.

In order to facilitate the following description, the coordinate axes are set as follows.

An X-axis is set in the direction in which the linear hot cathodes 107 are extended. A Y-axis is set in the direction orthogonal to the X-axis in a plane of the back electrode 106. A Z-axis is set in the normal direction from the back electrode 106 toward the phosphor screen 102.

The back electrode 106 is fixed by welding or the like to fixing stands 115 that have been fixed to the rear case 104 with low melting point solder glass or the like. Springs 116 for extending the linear hot cathodes 107 are fixed by welding or the like to bases 117 that have been fixed to the rear case 104 with low melting point solder glass or the like. The linear hot cathodes 107 are extended by the springs 116 on the phosphor screen 102 side of the back electrode 106 with a predetermined tension.

Electrode fixing metal fittings 118 have insulating films 118*a* formed on its phosphor screen 102 side and are placed on the back electrode 106 at the upper and lower ends in the Y-axis direction.

End metal fittings 119 are fastened to the electrode unit 108 at the left and right ends in the X-axis direction using screws or the like with insulating spacers 120 being sandwiched therebetween, which is then fixed to the electrode fixing metal fittings 118.

In the extracting electrode 111, through holes 111*a* are formed opposing respective linear hot cathodes 107 at predetermined spaces in the X-axis direction.

The modulating electrode 112 is formed in a bamboo-blind-like shape by placing long and narrow electrodes 112*b* in the Y-axis direction in the X-Y plane at suitable spaces from one another corresponding to the pitch of the through holes 11*a* in the X-axis direction in the extracting electrode 111. The electrodes 112*b* have through holes 112*a* at the positions opposing the rows of through holes 111*a* along the Y-axis in the extracting electrode 111.

The horizontal deflection electrode 113 is formed by combining comb-teeth-shaped electrodes 113*a* and 113*b* with each other at suitable spaces in the same plane (in the X-Y plane). The electrodes 113*a* are connected to each other at their left and/or right ends in the X-axis direction and the electrodes 113*b* also at their left and/or right ends in the X-axis direction. The horizontal deflection electrode 113 is placed so that the center positions of slits 113*c* formed between projecting parts 113*ab* and 113*bb* that are combined with each other correspond to respective positions of the through holes 111*a* in the extracting electrode 111.

The vertical deflection electrode 114 is formed by combining comb-teeth-shaped electrodes 114*a* and 114*b* with each other at suitable spaces in the same plane (in the X-Y plane). The electrodes 114*a* are connected to each other at their left and/or right ends in the X-axis direction and the electrodes 114*b* also at their left and/or right ends in the X-axis direction. Slits 114*c* are formed between the electrodes 114*a* and 114*b* in the X-axis direction at the positions corresponding to the positions of the linear hot cathodes 107.

The wire electrodes 109 are formed by extending and fixing wires 109*a* to the picture-frame-like grid frame 110 at the positions opposing the rows of the through holes 111*a* along the Y-axis in the extracting electrode 111 so as to correspond to the pitch of the through holes 111*a* in the X-axis direction in the extracting electrode 111.

The grid frame 110 is fixed to the end metal fittings 119 using screws or the like with insulating spacers 121 being sandwiched therebetween. In this case, the grid frame 110 and the end metal fittings 119 are fixed using screws with insulating bushings 122 being sandwiched therebetween so as to be insulated electrically from each other.

Then, the front case 103 is placed over the structure comprising members from the back electrode 106 to the wire electrodes 109 that have been placed on the rear case 104 as described above. The front case 103 and the rear case 104 are fixed to each other by heating with outgoing terminals (not shown in the figure) being sandwiched therebetween using low melting point solder glass formed at the peripheries of the front case 103 and the rear case 104, thus being sealed to obtain the vacuum case 105. Then, the inside of the vacuum case 105 is evacuated through an exhaust pipe (not shown in the figure). The exhaust pipe is then closed, thus completing the flat-type display apparatus 101.

In this case, the front case 103 is placed by positioning stripes formed in the Y-axis direction constructing the phosphor screen 102 formed on the inner face of the front case 103 relative to the wires 109*a* forming the wire electrodes 109 with respect to the X-axis direction.

The flat-type display apparatus 101 thus formed displays images, characters, and the like with high precision by: focusing, modulating, and deflecting electron beams 123 generated from the linear hot cathodes 107 by the extracting electrode 111, the modulating electrode 112, the horizontal deflection electrode 113, and the vertical deflection electrode 114 that form the electrode unit 108; further focusing the electron beams 123 by the wire electrodes 109; and irradiating the electron beams 123 onto the phosphor screen 102 to cause light emission.

However, in order to display images, characters, and the like with high precision excellently without causing shifts in color in the conventional flat-type display apparatus, the wire electrodes 109 and the stripes forming the phosphor screen 102 must be positioned with a precision within ±15 μm.

In the conventional configuration, the stripes of the phosphor screen 102 formed on the inner face of the front case 103 are positioned relative to the wire electrodes 109 fixed to the rear case 104 with respect to the X-axis direction. In this stage, the wire electrodes and the stripes are positioned with a precision within ±10 μm in the X-axis direction.

However, in a later process, the rear case 104 and the front case 103 are fixed to each other by heating with low melting point solder glass with the outgoing terminals (not shown in the figure) being sandwiched therebetween.

In this process, the gap formed between the rear case 104 and the front case 103 due to the outgoing terminals and the low melting point solder glass that has not been melted yet is reduced by heating under loading in the Z direction. Thus, the rear case 104 and the front case 103 adhere and are thus fixed. The rear case 104 and the front case 103 are bonded by heating with their positions in the X-axis and Y-axis directions to be regulated. However, when the gap is reduced, the regulated condition in the X-axis and Y-axis directions is impaired, thus frequently causing a position shift on the order of several tens of μm.

Therefore, in the completed flat-type display apparatus 101, the electron beams 123 cannot be irradiated onto predetermined positions on the phosphor screen 102, thus causing shifts in color. As a result, excellent images were not obtained.

DISCLOSURE OF THE INVENTION

It is an object of the present invention to provide a flat-type display apparatus in which the position shift between a phosphor screen 102 and wire electrodes 109 can be suppressed within a tolerance in a later process, thus obtaining excellent images.

In order to attain this object, the flat-type display apparatus of the present invention comprises, inside a vacuum case formed of a rear case and a front case having a phosphor screen formed on its inner face: a back electrode; electron beam sources; an electrode unit formed of a plurality of electrodes for controlling electron beams; and extended electrodes fixed to a grid frame. The flat-type display apparatus is characterized in that the grid frame to which the extended electrodes have been fixed is placed in and fixed to the front case.

As described above, in the flat-type display apparatus of the present invention, electron beams generated from linear hot cathodes are focused, modulated, and deflected by an extracting electrode, a modulating electrode, a horizontal deflection electrode, and a vertical deflection electrode that form an electrode unit and are further focused by wire electrodes to be focused at predetermined positions on the phosphor screen, thus irradiating the phosphor screen to cause light emission. In the flat-type display apparatus, the grid frame to which the wire electrodes have been fixed while being extended thereon is positioned and attached on the front case side. In other words, the grid frame is fixed to the front case, preferably using a supporting frame provided for the front case, by positioning stripes of the phosphor screen formed on the inner face of the front case and the extended electrodes fixed to the grid frame. This enables the position shift between the wire electrodes and the phosphor screen, which occurs in the later process, to be suppressed within a tolerance. As a result, the flat-type display apparatus that can display images, characters, and the like with high precision can be provided.

BEST MODE FOR CARRYING OUT THE INVENTION

Figure 1:
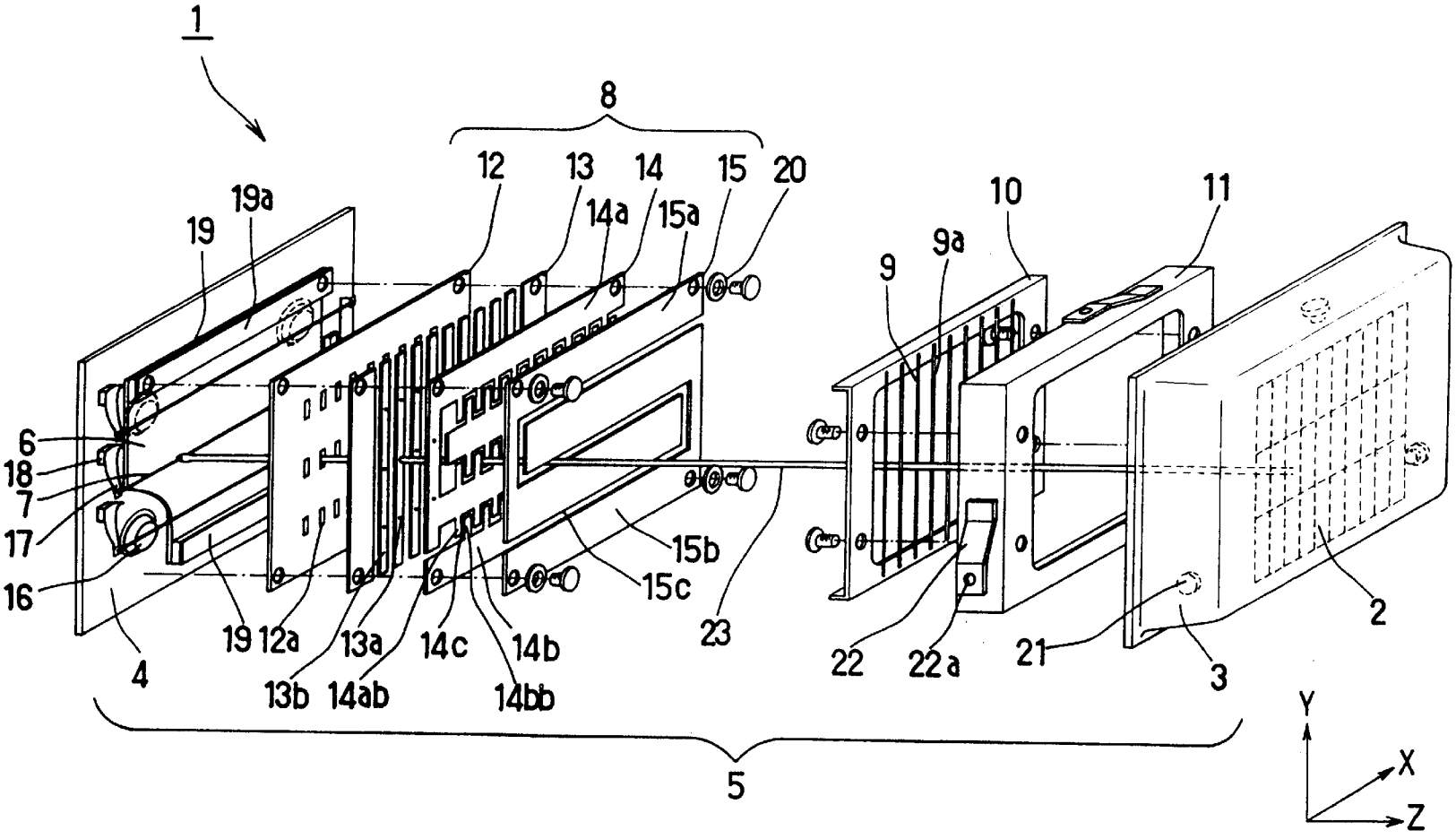
FIG. 1 is an exploded perspective view showing a schematic assembly configuration of an example of the flat-type display apparatus according to the present invention.
Figure 2:
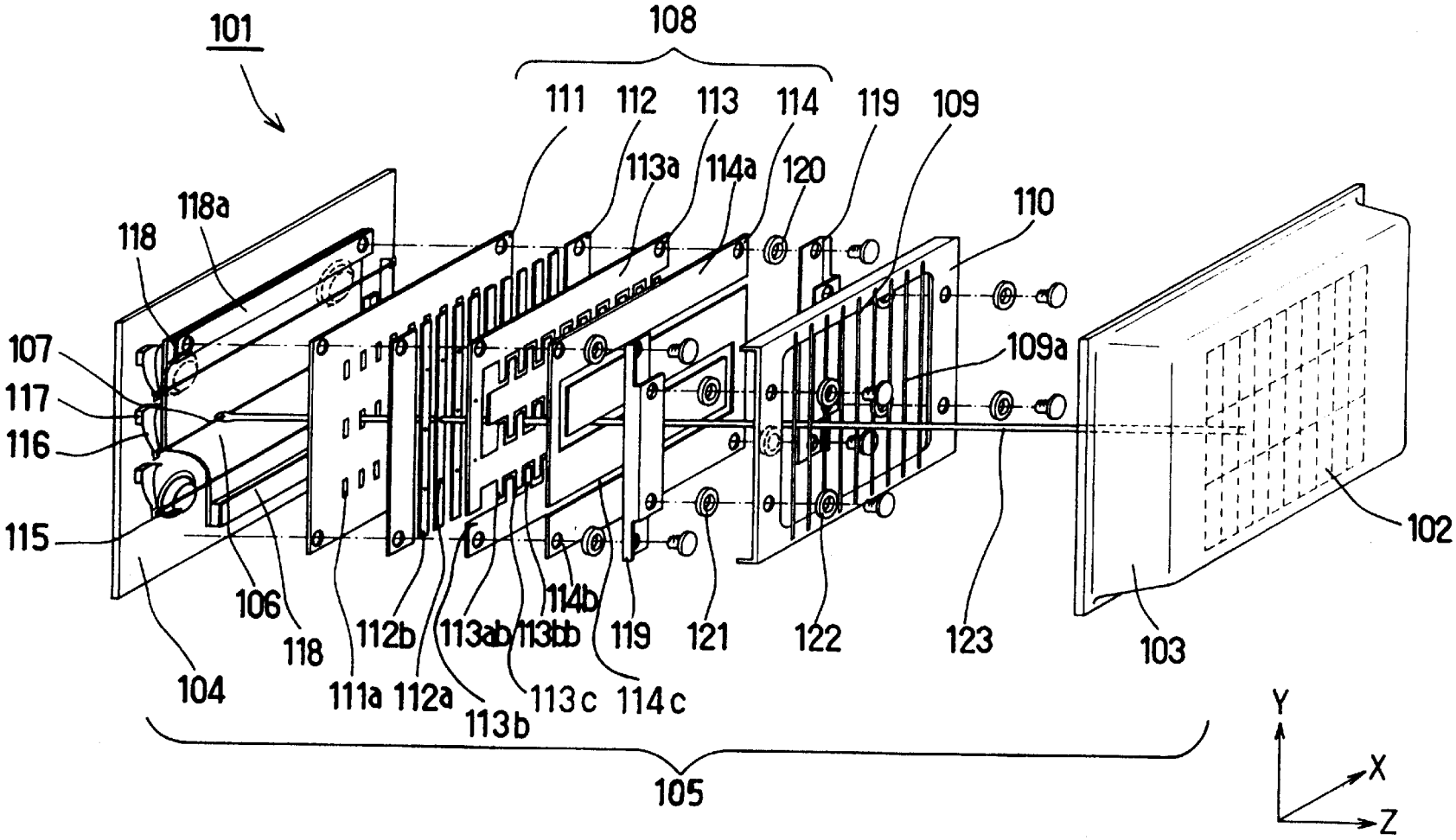
FIG. 2 PRIOR ART
FIG. 2 is an exploded perspective view showing a schematic assembly configuration of an example of conventional flat-type display apparatuses.

An embodiment of the flat-type display apparatus according to the present invention will be explained with reference to FIG. 1 as follows.

A flat-type display apparatus 1 comprises: a back electrode 6; a plurality of linear hot cathodes 7 as electron beam sources; a flat electrode unit 8; a grid frame 10 to which wire electrodes 9 as extended electrodes have been fixed while being extended thereon in the direction orthogonal to the linear hot cathodes 7; and a supporting frame 11 for fixing the grid frame 10, which are housed in a vacuum case 5 formed of a rear case 4 and a front case 3 having a phosphor screen 2 formed on its inner face.

The electrode unit 8 comprises an extracting electrode 12, a modulating electrode 13, a horizontal deflection electrode 14, and a vertical deflection electrode 15. The respective electrodes are electrically insulated from and are fixed to one another while maintaining predetermined spaces.

In order to facilitate the following description, the coordinate axes are set as follows.

An X-axis is set in the direction in which the linear hot cathodes 7 are extended. A Y-axis is set in the direction orthogonal to the X-axis in a plane of the back electrode 6. A Z-axis is set in the normal direction from the back electrode 6 toward the phosphor screen 2.

The back electrode 6 is fixed by welding or the like to fixing stands 16 that have been fixed to the rear case 4 with low melting point solder glass or the like. Springs 17 for extending the linear hot cathodes 7 are fixed by welding or the like to bases 18 that have been fixed to the rear case 4 with low melting point solder glass or the like. The linear hot cathodes 7 are extended by the springs 17 on the phosphor screen 2 side of the back electrode 6 with a predetermined tension.

Electrode fixing metal fittings 19 have insulating films 19*a* formed on its phosphor screen 2 side and are placed on the back electrode 6 at the upper and lower ends in the Y-axis direction.

The electrode unit 8 is fixed to the electrode fixing metal fittings 19 using screws or the like with insulating spacers 20 being sandwiched therebetween.

In the extracting electrode 12, through holes 12*a* are formed opposing respective linear hot cathodes 7 at predetermined spaces in the X-axis direction.

The modulating electrode 13 is formed in a bamboo-blind-like shape by placing long and narrow electrodes 13*b* in the Y-axis direction in the X-Y plane at suitable spaces from one another corresponding to the pitch of the through holes 12*a* in the X-axis direction in the extracting electrode 12. The electrodes 13*b* have through holes 13*a* at the positions opposing the rows of through holes 12*a* along the Y-axis in the extracting electrode 12.

The horizontal deflection electrode 14 is formed by combining comb-teeth-shaped electrodes 14*a* and 14*b* with each other at suitable spaces in the same plane (in the X-Y plane). The electrodes 14*a* are connected to each other at their left and/or right ends in the X-axis direction and the electrodes 14*b* also at their left and/or right ends in the X-axis direction. The horizontal deflection electrode 14 is placed so that center positions of slits 14*c* formed between projecting parts 14*ab* and 14*bb* that are combined with each other correspond to respective positions of the through holes 12*a* in the extracting electrode 12.

Similarly, the vertical deflection electrode 15 is formed by combining comb-teeth-shaped electrodes 15*a* and 15*b* with each other at suitable spaces in the same plane (in the X-Y plane). The electrodes 15*a* are connected to each other at their left and/or right ends in the X-axis direction and the electrodes 15*b* also at their left and/or right ends in the X-axis direction. Slits 15*c* are formed between the electrodes 15*a* and 15*b* in the X-axis direction at the positions corresponding to the positions of the linear hot cathodes 7.

The wire electrodes 9 are formed by extending and fixing wires 9*a* to the picture-frame-like grid frame 10 at the positions opposing the rows of the through holes 12*a* along the Y-axis in the extracting electrode 12 corresponding to the pitch of every two trios of phosphor stripes (one trio includes three colors of red, green, and blue) in the X-axis direction on the phosphor screen 2.

Stud pins 21 are formed at predetermined positions on three sides out of four sides at the inner periphery of the front case 3. Plate springs 22 are fixed to predetermined positions at the outer peripheral portion of a picture frame-like supporting frame 11. By inserting stud pins 21 into fitting holes 22*a* formed in the plate springs 22, the supporting frame 11 is placed in the front case 3 with its position being regulated in the X, Y, and Z axes directions.

The wires 9*a* of the wire electrodes 9 are positioned relative to the stripes of the phosphor screen 2 with respect to the X-axis direction. Then, the grid frame 10 is fixed to the supporting frame 11.

Thus, the front case 3 provided with the wire electrodes 9 that has been fixed therein using the supporting frame 11 is placed over the structure comprising members from the back electrode 6 to the electrode unit 8 that have been placed on the rear case 4 as described above. The front case 3 and the rear case 4 are fixed to each other by heating with outgoing terminals (not shown in the figure) being sandwiched therebetween using low melting point solder glass formed at the peripheries of the front case 3 and the rear case 4, thus being sealed to obtain the vacuum case 5. Then, the inside of the vacuum case 5 is evacuated through an exhaust pipe (not shown in the figure). The exhaust pipe is then closed, thus completing the flat-type display apparatus 1.

In this case, the front case 3 is placed by positioning the wire electrodes 9 fixed thereto using the supporting frame 11 relative to the slits 14*c* in the horizontal deflection electrode 14 with respect to the X-axis direction.

According to the present embodiment, the stripes of the phosphor screen 2 formed on the inner face of the front case 3 and the wire electrodes 9 extended on and fixed to the grid frame 10 are positioned, which is then fixed to the supporting frame 11 provided for the front case 3. Therefore, the position shift between the stripes of the phosphor screen 2 and the wire electrodes 9 can be suppressed within a tolerance in the later process. Consequently, the flat-type display apparatus 1 in which the electron beams 23 can be irradiated onto predetermined positions on the phosphor screen 2 can be obtained.

The grid frame 10 to which the wire electrodes 9 have been fixed while being extended thereon may be attached to the front case 3 directly without using the supporting frame 11. Further, the grid frame 10 may be attached to the front case 3 using a jig having another configuration instead of the supporting frame 11 shown in FIG. 1.

Any of the embodiments described above is directed merely to make the technical contents of the present invention clear. The present invention should not be considered to be limited to such concrete examples. The present invention can be carried out by making changes variously which come within the range of the spirit and the claims of the present invention and is to be considered broadly.

INDUSTRIAL APPLICABILITY

The flat-type display apparatus of the present invention can display images, characters, and the like with high precision. Therefore, by utilizing such characteristics, particularly it can be used suitably as a flat-type display apparatus in which especially high display quality is required such as a television receiver, a computer-terminal display unit, or the like.

What is claimed is:

1. A flat-type display apparatus comprising, inside a vacuum case formed of a rear case and a front case having a phosphor screen formed on its inner face:

a back electrode;

electron beam sources;

an electrode unit formed of a plurality of electrodes for controlling electron beams; and extended electrodes fixed to a grid frame, wherein the grid frame to which the extended electrodes have been fixed is placed in and fixed to the front case.

2. The flat-type display apparatus according to claim 1, wherein the grid frame is placed in and fixed to the front case using a supporting frame provided for the front case.

* * * * *

UNITED STATES PATENT AND TRADEMARK OFFICE

CERTIFICATE OF CORRECTION

PATENT NO. : 6,278,235 B1
DATED : August 21, 2001
INVENTOR(S) : Nakatani et al.

It is certified that error appears in the above-identified patent and that said Letters Patent is hereby corrected as shown below:

Title page,
Item [22], PCT Filed: "1990" should read -- 1998 --

Signed and Sealed this

Thirtieth Day of April, 2002

*Attest:*

*Attesting Officer*

JAMES E. ROGAN
*Director of the United States Patent and Trademark Office*